US005176258A

United States Patent [19]

Antal

[11] Patent Number: 5,176,258

[45] Date of Patent: Jan. 5, 1993

[54] SEALED PACKAGE AND METHOD FOR SEALING PRODUCTS IN A PACKAGE

[75] Inventor: John L. Antal, Palm Harbor, Fla.

[73] Assignee: Linvatec Corporation, Largo, Fla.

[21] Appl. No.: 679,902

[22] Filed: Apr. 3, 1991

[51] Int. Cl.[5] ..... B65D 73/00

[52] U.S. Cl. ..... 206/461; 206/438; 206/471; 206/523

[58] Field of Search ..... 206/363, 438, 461, 467, 206/469, 471, 523, 524, 45.14

[56] References Cited

U.S. PATENT DOCUMENTS

| | | | |
|---|---|---|---|
| D. 273,565 | 4/1984 | Driskell et al. | 206/461 |
| 3,301,392 | 1/1967 | Regan, Jr. | 206/438 |
| 3,681,063 | 10/1972 | Lahay | 206/370 |
| 4,101,031 | 7/1978 | Cromie | 206/438 |
| 4,126,860 | 8/1980 | Heimann . | |
| 4,324,331 | 4/1982 | Ignasiak | 206/363 |
| 4,453,629 | 6/1984 | Goldberg | 206/461 |
| 4,576,282 | 3/1986 | Kapralis | 206/524 |
| 4,657,138 | 4/1987 | Watson | 206/523 |
| 4,730,729 | 3/1988 | Monch | 206/363 |
| 4,739,778 | 4/1988 | Christie | 206/467 |
| 4,807,752 | 2/1989 | Chodorow | 206/438 |
| 4,842,141 | 6/1989 | Segal | 206/471 |
| 4,848,541 | 7/1989 | Paliotta et al. | 206/45.14 |

FOREIGN PATENT DOCUMENTS

| | | | |
|---|---|---|---|
| 1030845 | 5/1966 | United Kingdom . | |
| 1580791 | 12/1980 | United Kingdom | 206/469 |

OTHER PUBLICATIONS

Techform, Inc. "Custom Thermoforming" brochure Nov. 15, 1982.

Packing Reference Issue, "Basic Thermoformed Card Pack Constructions", 1986 vol. 31, No. 4, p. 134.

*Primary Examiner*—David T. Fidei

[57] ABSTRACT

A package includes a peripheral flange around a blister defining an open cavity for receiving a product and a compressible insert for securing the product against movement in the cavity. At least one projection on the insert extends laterally from the cavity over the peripheral flange, and a lid covering the cavity is continuously sealed to the peripheral flange and the projection along a single seal. A method for sealing products in the package includes supporting the peripheral flange on a rigid support surface, and compressing the lid against the peripheral flange with heat and pressure to compress the projection between the lid and the peripheral flange and heat seal the projection to the lid simultaneously with sealing of the lid to the peripheral flange along the peripheral seal.

22 Claims, 1 Drawing Sheet

SEALED PACKAGE AND METHOD FOR SEALING PRODUCTS IN A PACKAGE

BACKGROUND OF THE INVENTION

1. Field Of The Invention

The invention pertains to sealed packages and, more specifically, to an improved, sealed blister package for securing products therein prior to use and to a method for sealing products in a blister package.

2. Description Of The Prior Art

Sealed blister containers for holding products have been proposed, and such containers are useful for holding products, such as pre sterilized medical devices, that must be isolated from the environment prior to use due to the ability of the containers to be hermetically sealed. Illustrative blister containers for holding sterile medical devices are shown in U.S. Pat. Nos. 4,324,331 to Ignasiak and 4,216,860 to Heimann and, generally, include an open, relatively rigid blister tray having a peripheral flange and a channel formed interiorly of the peripheral flange for receiving a pre-sterilized medical device. One or more foam plugs are positioned in the channel at discrete locations to hold distinct parts of the medical device against the tray and inhibit movement of the medical device within the container prior to use. A paper backing sheet is positioned over the open tray in overlapping engagement with the peripheral flange and the plugs and is continuously sealed or bonded to the tray along the peripheral flange to close the tray, maintain a sterile environment therein and urge the plugs toward the parts of the medical device being held against the tray. Additionally, the backing sheet is bonded directly to the plugs to permit the container to be opened by manually peeling away the backing sheet with the plugs attached thereto, such that the medical device can be dropped freely from the container onto a sterile field without manual contact with the medical device itself. The sealing process typically involves thermally compressing the backing sheet against the flange and plugs to bond the backing sheet to the flange and plugs, respectively. Because the plugs are located interiorly of the peripheral flange at discrete locations, the backing sheet must be compressed at multiple, distinct areas producing tensile stresses in the paper backing sheet that could tear or weaken the backing sheet. Furthermore, the foam plugs are contained entirely within the peripheral confines of the channel and move downwardly in the channel when the backing sheet is compressed against the plugs due to the open cell characteristics of foam. Therefore, the backing sheet must be compressed against the plugs with compressive forces significantly greater than required to be exerted against the relatively rigid peripheral flange to bond the backing sheet to the plugs. The requirement for relatively high compressive forces detracts from the efficiency of the sealing process and can produce an unequal force distribution in the backing sheet resulting in structural impairment thereof. Even when the required high compressive forces are uniformly applied, the backing sheet nonetheless frequently fails to bond to the plugs due to the plugs being able to move considerably downwardly within the channel when the backing sheet is compressed thereagainst, and the unbonded plugs can drop onto the sterile field along with the medical device when the backing sheet is peeled from the tray. Consequently, conventional blister containers usually employ a coating on the backing sheet to facilitate thermal bonding, and the coating must be applied to the backing sheet at each of the distinct sealing areas for the plugs. The need for thermal bonding facilitating coatings significantly complicates the sealing process and commonly fails to enhance bonding of the backing sheet to the plugs. Failure of the backing sheet to bond to the plugs can not be visually discerned because the interface of the backing sheet and the plugs is concealed entirely from view by the backing sheet and the plugs, respectively. Proper bonding of the backing sheet to the plugs is, therefore, difficult to ascertain after the backing sheet has been applied and has a negative impact on quality control.

A further drawback to conventional sealed blister containers is that failure of the backing sheet to bond to the plugs allows the plugs to move within the containers subsequent to the containers being sealed along the peripheral flange. Accordingly, the plugs are rendered ineffective in holding a medical device against the tray, and the medical device can shift and move within the container during shipping and handling prior to use. Movement of the medical device within the container prior to use is undesirable because the medical device can be damaged, and relatively fragile medical devices are particularly likely to be compromised by such movement. Prior art blister containers secure the plugs against movement within the container by forming the tray with specially configured walls adjacent the plugs to inhibit movement of the plugs and, therefore, the medical device, within the channel. Because different medical devices must be held by the plugs at different points to effectively constrain the medical device against movement within the channel, the trays must be highly customized for specific medical devices to locate the walls in the proper position for the plugs. Moreover, different sizes and configurations of plugs are required for diverse medical devices, and the walls must be specially configured in accordance with the plugs being utilized. A single tray usually cannot be employed for diverse medical devices and plugs, and conventional blister containers are thusly limited. Additionally, the blister container holding the medical device is frequently sterilized by gas or radiation sterilization techniques after the backing sheet has been sealed thereto; however, the plugs commonly shrink relative to the walls during sterilization negating any benefits derived from the walls in restricting movement of the plugs within the channel. Another disadvantage of conventional blister containers is that the plugs holding discrete parts of the medical device allows unsupported parts of the medical device remote from the plugs to move within the channel. Such movement is particularly likely when the medical device is made from a flexible material and can structurally impair the medical device.

SUMMARY OF THE INVENTION

Accordingly, it is an object of the present invention to overcome the aforementioned disadvantages of prior art sealed blister packages and methods for sealing products in blister packages.

It is also an object of the present invention to provide a blister package wherein a single seal bonds a cover sheet to the package and to an insert positioned in the package for holding a product therein.

A further object of the present invention is to enhance bonding between a cover sheet of a blister package and a flexible, compressible insert positioned in the package for securing a product therein.

Moreover, it is an object of the present invention to provide a blister package singly capable of receiving diverse sizes and configurations of products and inserts for securing the products against movement within the package.

Another object of the present invention is to provide a blister package wherein movement of a compressible insert in the package is prevented by securing the insert between a flange on the package and a cover sheet secured to the flange.

An additional object of the present invention is to provide a method for effectively and reliably sealing a cover sheet to a blister package simultaneously with sealing of the cover sheet to a compressible insert within the package along a single seal while utilizing relatively low sealing forces.

Some of the advantages of the present invention are that the cover sheet does not have to be bonded to the package at multiple, discrete sealing areas, the need for bonding facilitating coatings is eliminated, specially configured walls on the package for preventing movement of the insert are not required, the sealing force necessary to bond the cover sheet to the insert is reduced, sealing forces are distributed equally across the cover sheet, the insert holds a product by engaging the product over a substantial portion of the length and width of the product, a single insert can hold one or more products, the package can be sterilized after the cover sheet has been bonded thereto without adversely affecting securement of the insert against movement within the package and bonding of the cover sheet to the insert can be visually confirmed.

These and other objects, attributes and advantages are obtained with the present invention as characterized by a blister package including a peripheral flange around a central blister defining an open cavity for receiving a product and a flexible, compressible insert positionable in the cavity to hold and secure the product against movement within the cavity. Opposing side flanges on the insert extend laterally from the cavity over the peripheral flange, and a cover sheet covering the cavity overlaps the peripheral flange continuously around the central blister and tightly compresses the side flanges against the peripheral flange to secure the insert within the package. The cover sheet is bonded continuously to the peripheral flange and to the side flanges along a single peripheral seal permitting the cover sheet to be manually peeled away from the peripheral flange while the side flanges remain attached to the cover sheet to allow the product to be dropped onto a sterile field without manual contact with the product. According to the method of the present invention, the peripheral flange is supported on a rigid support surface and the cover sheet is positioned over the peripheral flange and the side flanges to cover the open cavity. A heated sealing plate compresses the cover sheet against the peripheral flange to compress the side flanges between the cover sheet and the peripheral flange while bonding the cover sheet to the peripheral flange simultaneously with bonding of the side flanges to the cover sheet along a single peripheral seal.

These and other objects and advantages of the present invention will become apparent from the following description of the preferred embodiment taken in conjunction with the accompanying drawings.

DESCRIPTION OF THE PREFERRED EMBODIMENT

Figure 1:
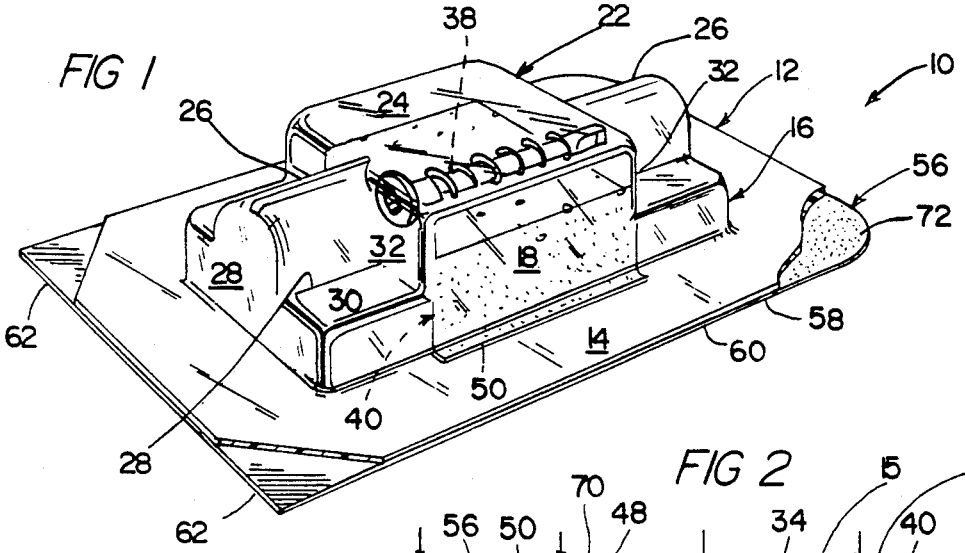
FIG. 1 is a perspective view of a sealed package according to the present invention.
Figure 2:
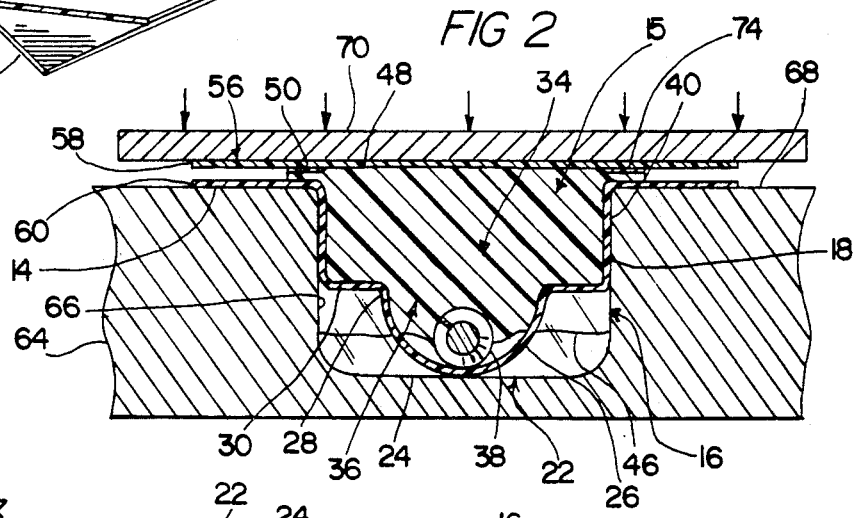
FIG. 2 is a broken, end sectional view of the sealed package of FIG. 1 showing the lid being heat sealed to the insert and the peripheral flange.
Figure 3:
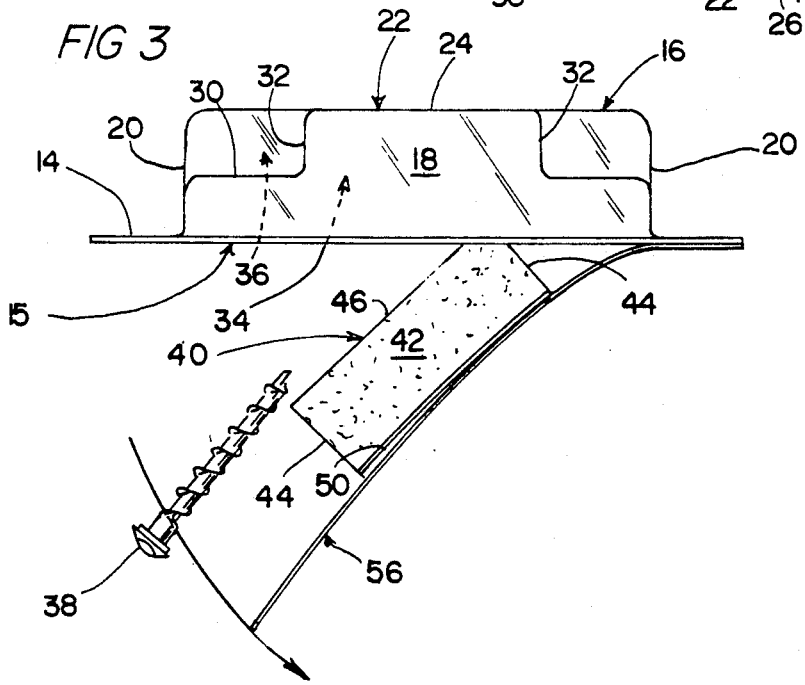
FIG. 3 is a side view of the sealed package of FIG. 1 showing the insert remaining attached to the lid during opening of the package.

As shown in FIGS. 1 3, the package 10 of the present invention includes a pre-formed, semi-rigid body 12 having a flat, or planar, peripheral flange, rim or border 14 of generally uniform width and thickness disposed around an open cavity or recess 15 defined by a central blister or depression 16 in the body 12. The blister 16 is sized and configured to hold one or more diverse products, such as surgical screws, washers, tacks and the like, in the cavity 15, and the size and configuration of the blister 16 can vary in accordance with the product to be held. The blister 16, as shown by way of example in FIGS. 1–3, includes a pair of spaced, generally parallel side walls 18 joined generally perpendicularly to the peripheral flange 14, a pair of generally parallel end walls 20 joined to the side walls 18 and to the peripheral flange 14 and a wall 22 joining the side walls 18 and end walls 20. The wall 22 includes a surface 24 generally parallel to the peripheral flange 14 extending transversely between the side walls 18 centrally positioned inwardly of the end walls 20 and semi-cylindrical walls 26 joined to the surface 24 extending longitudinally therefrom to the end walls 20. As shown in FIG. 2, semi-cylindrical walls 26 define in end section arcs of circles having central longitudinal axes in longitudinal alignment and disposed parallel to and centrally between the side walls 18. The semi-cylindrical walls 26 are tangential with the surface 24, and diametric lower ends 28 of the semi-cylindrical walls 26 are joined to recessed surfaces 30 flanking the surface 24 and the lower ends 28 of the semi-cylindrical walls 26 and joining the lower ends 28 to the side walls 18 and the end walls 20. The recessed surfaces 30 are positioned between the surface 24 and the flange 14, and shoulders 32 join the recessed surfaces 30 to the surface 24 and the side walls 18 to the semi-cylindrical walls 26. Cavity 15 includes a central recess 34 having a length measured between shoulders 32, a width measured between side walls 18 and a depth measured between flange 14 and surface 24, and a semi-cylindrical recess 36 bisecting the central recess 34 having a length measured between the end walls 20, a maximum width measured between the recessed ends 28 and a depth measured between recessed surfaces 30 and surface 24. One or more products, such as a medical device or surgical screw 38 can be positioned in the central recess 34 adjacent the surface 24, and a variety of size and configured products can be singly or multiply received in the central recess 34. Additionally, relatively longitudinally elongated products having a length greater than the length of the central recess 34 can be accommodated in the blister 16 via the relatively longer length semi-cylindrical recess 36.

A flexible insert 40 for insertion in the cavity 15 to hold the product 38 in engagement with the upper surface 24 and prevent movement and dislocation of the product 38 within the package 10 prior to use includes a resilient block having spaced parallel sides 42, parallel ends 44 joined to the sides 42, a planar, top 46 joined to the sides 42 and ends 44, a planar, base 48 generally co-extensive in surface area with the top 46 joined to the sides 42 and ends 44, and side flanges or projections 50 of reduced depth or thickness co-planar with the base 48 extending laterally outwardly from the sides 42 continuously therealong. A cover sheet or lid 56 for closing the cavity 15 and sealing the product 38 and insert 40 in the body 12 includes a flexible sheet sized and configured to completely cover the cavity 15 and to extend over the peripheral flange 14 at least a small distance continuously around the cavity 15. As shown in FIGS. 1-3, the lid 56 is defined by a peripheral edge 58 to be aligned with a peripheral edge 60 of the flange 14 when the lid 56 is positioned over the flange 14 covering the cavity 15, and the peripheral flange 14 is notched to permit corners 62 of the lid 56 to project independently outwardly from the edge 60 of the peripheral flange 14 to facilitate grasping of the lid 56 via the corners 62.

Preferably, the body 12 is made from a transparent material capable of being formed or molded to define a semi-rigid peripheral flange or border around a blister or depression defining a cavity for receiving one or more products and an insert for securing the one or more products in engagement with the body 12. A preferred material for the body 12 is a semi-rigid plastic material, such as polyvinyl chloride or the like, that can be vacuum or thermally formed, maintain a hermetically sterile environment and is suitable for heat sealing a lid thereto. The cavity 15 is preferably sized to receive one or more products in the central recess 34 and is preferably configured with cylindrical recess 36 to accommodate relatively elongate products, although the cavity 15 can be sized and configured in any selected manner in accordance with the one or more products to be held. Preferably, the insert 40 is fabricated from a flexible, compressible material that deforms around the product being held and thereby urges the product into engagement with the surface 24. A preferred material for the insert 40 is 2.0 P.C.F. polyester urethane foam that resists shrinkage when gas or radiation sterilized and has a cell count of approximately 38-44 cells/inch. The height, or depth, of the insert 40 as measured between the top 46 and the base 48 is selected to permit the top 46 to urge the product 38 against the upper surface 24 of the body 12 when the inert 40 is positioned in the central recess 34 with the side flanges 50 overlapping the peripheral flange 14 on the body 12. Preferably, the length of the insert 40 as measured between the ends 44 and the width of the insert 40 as measured between the sides 42 are selected to allow the insert 40 to substantially fill the volume of the central recess 34 and permit the top 46 to engage one or more products over a substantial portion of the length and width of the one or more products facing the insert 40. The side flanges 50 extend laterally outwardly from the sides 42 of the insert 40 a short distance and, according to one embodiment for the insert 40, the side flanges 50 are approximately $\frac{1}{8}$" deep and extend from the sides 42 approximately 3/16" continuously along the length of the insert 40. The lid 56 is preferably made from a material capable of being heat sealed or bonded to the body 12 and the insert 40 by thermal compression, and a preferred material is spun-bonded polyolefin membrane or the like, such as TYVEK, which produces a colored interface between the peripheral flange 14 and the lid 56 when the lid 56 is thermally bonded thereto. The lid 56 is sized and configured to cover the cavity 15 in its entirety and the peripheral flange 14 continuously around the cavity 15; and, preferably, the lid 56 is sized and configured to have the peripheral edge 58 capable of being substantially aligned in overlapping fashion with the peripheral edge 60 on the flange 14.

In order to produce a sealed package in accordance with the present invention, as shown in FIG. 2, the body 12 is placed in a support 64 having a female cavity 66 therein for receiving the blister 16 and a rigid, planar support surface 68 surrounding the female cavity 66 for supporting the peripheral flange 14 thereon when the blister 16 is placed in the female cavity 66. A product, such as the surgical screw 38, is placed in the central recess 34 and opposing ends of the product can project into one or both opposing ends of the semi-cylindrical recess 36. The insert 40 is positioned over the product 38 in the central recess 34 such that the insert 40 substantially fills the central recess 34, the side flanges 50 overlap and are supported on the peripheral flange 14 and the top 46 of the insert 40 deforms around the product 38 and engages a substantial portion of the length and width of the product 38 facing the top 46. The lid 56 is placed over the body 12 to cover the cavity 15 in its entirety, to extend over the peripheral flange 14 continuously around the cavity 15 and to align the peripheral edge 58 on the lid 56 with the peripheral edge 60 on the flange 14. A heated sealing plate 70 sized and configured to cover the lid 56 is pressed vertically downwardly against the lid 56 to apply compressive sealing forces thereto in a direction normal to the support surface 68. Sealing plate 70 compresses the lid 56 against the peripheral flange 14 while simultaneously compressing the side flanges 50 between the lid 56 and the peripheral flange 14. Heat and pressure applied by the sealing plate 70 bonds the lid 56 to the peripheral flange 14 continuously along the interface of the lid 56 and the peripheral flange 14 to produce a colored peripheral seal 72 disposed continuously around the blister 16, and the lid 56 is simultaneously bonded to the side flanges 50 along sealing areas 74, shown in FIG. 2, contained within the peripheral seal 72. In other words, the lid 56 is bonded to both the peripheral flange 14 and the side flanges 50 of the insert 40 along a single peripheral seal 72 without the need for multiple, discrete sealing areas interiorly of the peripheral flange 14 that could impose tensile stress on the lid 56 and result in damage to and weakening of the lid. The seal 72 is viewable through the flange 14 due to the body 12 being made of transparent material and permits visual inspection and confirmation of proper bonding of the lid 56 to the peripheral flange 14 and the side flanges 50. The side flanges 50 are bonded to the lid 56 reliably and effectively because the relatively small depth of the side flanges 50 is readily compressed between the lid 56 and the relatively rigid flange 14 as further rigidified by the support surface 64, and the need for bonding facilitating coatings is eliminated. Relatively less compressive force is required to bond the side flanges 50 to the lid 56 than would be required to bond other parts of the insert 40, such as the base 48, to the lid 56 because the base 48 is movable considerably downwardly within the central recess 34 when the insert 40 is compressed over its full depth or height. The base 48 of the insert 40 need not be bonded to the lid 56, and the sealing force required to be applied by the sealing plate 70 to bond the lid 56 to the insert 40 is reduced. Furthermore, the reduced sealing force is applied uniformly, or equally, across the lid 56 maintaining the structural integrity of the lid. The side flanges 50 being retained between the peripheral flange 14 and the lid 56 and being bonded to the lid 56 at sealing areas 74 prevent movement of the insert 40 and, therefore, dislocation of the product 38, within the package 10 without the need for specially configured movement restricting walls in blister 16. Additionally, the blister 16 can singularly accept a variety of inserts and products for sealing therein.

After sealing of the lid 56 thereto, the package 10 can be sterilized utilizing gas or radiation sterilization techniques. The insert 40 will not shrink as a result of the sterilization process, and the peripheral seal 72 maintains a sterile environment within the package 10 and prevents the insert 40 from moving or becoming detached from the lid 56 during shipping and handling of the package 10 prior to use. The lid 56 urges the top 46 of the insert 40 toward the surface 24, and the product 38 is positioned by the top 46 to engage the surface 24 and prevent dislocation of the product 38 within the package 10. Furthermore, the top 46 of the insert 40 supports a substantial portion of the length and width of the product 38 facing the insert 40 and inhibits movement or shifting of unsupported parts of the product. The package 10 is opened by manually grasping the corners 62 on the lid 56 and manually peeling the lid 56 away from the body 12 to break the peripheral seal 72. As the lid 56 is pulled away from the body 12, the insert 40 remains solidly attached to the lid 56 at sealing areas 74, and the product 38 can be freely dropped onto a sterile field, as shown in FIG. 3, without manually contacting the product 38 and without the insert 40 falling onto the sterile field.

Having described a preferred embodiment of a new and improved blister package and method for sealing products in a blister package, it is believed that other modifications, variations and changes will be suggested to those skilled in the art in view of the teachings set forth herein. It is therefore to be understood that all such variations, modifications and changes are believed to fall with the scope of the present invention as defined by the appended claims.

What is claimed is:

1. A package for holding a product comprising a body having a recess therein for receiving a product;

a foam insert disposed in said recess for holding the product within said body;

a cover disposed over said body and completely covering said recess;

flanges on said insert disposed laterally of said recess and compressed between said body and said cover; and a seal joining said cover to said body around said recess and to said flanges, whereby said insert remains joined to said cover and is removed with said cover when said cover is removed from said body.

2. A package as recited in claim 1 wherein said body includes a border disposed around said recess.

3. A package as recited in claim 2 wherein said insert is configured as block and said flanges include a pair of flanges extending laterally outwardly from said block and disposed between said border and said cover.

4. A package as recited in claim 3 wherein said cover includes a sheet extending over said border and said recess.

5. A package as recited in claim 4 wherein said cover compresses said flanges between said borer and said sheet and said seal includes a heat seal.

6. A package for holding at least one product comprising a body having a depression therein for receiving at least one product;

a solid block of foam material disposed in said depression for securing the at least one product in said depression, said block having a thickness;

a lid disposed over said body for covering said depression and said block;

a rim on said body disposed around said depression; and flanges of lesser thickness than said block extending from said block and disposed between said rim and said lid, said lid being continuously sealed to said flanges and said rim around said depression.

7. A package as recited in claim 6 wherein said depression defines an opening in said body and said rim is disposed around said opening.

8. A package as recited in claim 7 wherein said lid extends over said opening and said flanges when said lid is disposed over said body.

9. A package as recited in claim 8 further including a seal sealing said lid to said flanges and said rim.

10. A package as recited in claim 9 wherein said depression defines a plurality of cavities for receiving the at least one product.

11. A package as recited in claim 10 wherein said cavities include a central cavity and a pair of longitudinally aligned, semi-cylindrical cavities extending outwardly from said central cavity.

12. A package as recited in claim 11 wherein said body includes a pair of side walls, a pair of end walls joining said side walls and a connecting wall joining said side walls and said end walls defining said central cavity and said block is disposed in said central cavity in engagement with said side and end walls.

13. A package as recited in claim 12 wherein said block includes a surface for supporting the at least one product thereon and said lid urges said surface toward said connecting wall.

14. A package as recited in claim 13 wherein said surface positions the at least one product in engagement with said connecting wall.

15. A package as recited in claim 14 wherein said block is made from foam in its entirety.

16. A package as recited in claim 15 wherein said block is made from shrink-resistant, polyester urethane foam.

17. A package as recited in claim 9 wherein said flanges have lengths extending along said rim and said seal bonds said flanges to said lid continuously along said lengths.

18. A package as recited in claim 17 wherein said rim is made from transparent material and said seal is viewable through said rim.

19. A package as recited in claim 18 wherein said seal is colored.

20. A package as recited in claim 19 wherein said body is formed as a unitary, integral member of semi-rigid plastic.

21. A package as recited in claim 20 wherein said lid includes a sheet of heat-bondable, flexible paper.

22. A package for holding a product comprising a blister body defining a recess for receiving a product and a border disposed around said recess;

a foam insert disposed in said recess to hold the product within said body, said insert having a planar base with a pair of opposing co-planar flanges extending outwardly from said base and overlying said border; and a cover sheet disposed over said base and heat sealed to said border and said flanges continuously around said recess.

* * * * *

UNITED STATES PATENT AND TRADEMARK OFFICE

CERTIFICATE OF CORRECTION

PATENT NO. : 5,176,258

DATED : January 5, 1993

INVENTOR(S) : John L. Antal

It is certified that error appears in the above-identified patent and that said Letters Patent is hereby corrected as shown below:

Column 1, line 14, delete "pre sterilized" and replace with --pre-sterilized--.

Column 4, line 14, delete "1 3" and replace with --1-3--.

Column 7, line 63, after "as", insert --a--.

Column 8, line 2, delete "borer" and replace with --border--.

Signed and Sealed this

Twenty-sixth Day of October, 1993

*Attest:*

*Attesting Officer*

Bruce Lehman

BRUCE LEHMAN

*Commissioner of Patents and Trademarks*